US008858759B1

(12) United States Patent
Duggirala et al.

(10) Patent No.: US 8,858,759 B1
(45) Date of Patent: Oct. 14, 2014

(54) ENHANCEMENT OF SHEET DEWATERING USING SOY FLOUR OR SOY PROTEIN

(71) Applicant: Ecolab USA Inc., Naperville, IL (US)

(72) Inventors: Prasad Duggirala, Naperville, IL (US); Weiguo Cheng, Naperville, IL (US); Luiz W. Pace, Sao Paulo (BR)

(73) Assignee: Ecolab USA Inc., Naperville, IL (US)

( * ) Notice: Subject to any disclaimer, the term of this patent is extended or adjusted under 35 U.S.C. 154(b) by 0 days.

(21) Appl. No.: 13/938,845

(22) Filed: Jul. 10, 2013

(51) Int. Cl.

| | |
|---|---|
| ***D21H 17/22*** | (2006.01) |
| ***D21H 21/10*** | (2006.01) |
| ***D21H 21/50*** | (2006.01) |
| ***D21H 17/24*** | (2006.01) |

(52) U.S. Cl.
CPC ..... *D21H 17/24* (2013.01); *D21H 17/22* (2013.01)
USPC ..... 162/168.3; 162/158; 162/168.1; 162/168.2; 162/174; 162/184; 162/185; 530/378

(58) Field of Classification Search
USPC ..... 162/158, 168.1–168.3, 173, 174, 162/183–5; 530/350, 377, 378
See application file for complete search history.

(56) References Cited

U.S. PATENT DOCUMENTS

| | | | | |
|---|---|---|---|---|
| 5,676,796 | A * | 10/1997 | Cutts | 162/158 |
| 6,706,144 | B1 | 3/2004 | Furman, Jr. et al. | |
| 6,733,674 | B2 | 5/2004 | Sarkar et al. | |
| 7,641,766 | B2 | 1/2010 | St. John et al. | |
| 7,901,543 | B2 | 3/2011 | St. John et al. | |
| 8,071,524 | B2 * | 12/2011 | Horton | 510/295 |
| 2007/0256987 | A1 * | 11/2007 | Singleton et al. | 210/764 |
| 2011/0008637 | A1 * | 1/2011 | Broadus et al. | 428/537.5 |

OTHER PUBLICATIONS

Smook, Gary A., Handbook for Pulp and Paper Technologists, 2nd ed, Angus Wilde Publications, 1992, pp. 220.*

* cited by examiner

*Primary Examiner* — Dennis Cordray
(74) *Attorney, Agent, or Firm* — Brinks Gilson & Lione

(57) ABSTRACT

Methods and compositions for improving dewatering efficiency during a papermaking or pulp drying process are disclosed. The methods can include a step of adding a dewatering agent solution to a location on a paper machine or pulp drying machine. The dewatering agent solution can include a soy based component. The soy based component can be soy flour or soy protein. The dewatering agent solution can be added to a wet end location of the pulp drying machine or paper machine or it can be sprayed onto a paper sheet prior to entering the press section of a paper machine. Additional dewatering agent solutions can also be added. The additional dewatering agent solutions can include cationic polymers or surfactants.

15 Claims, 2 Drawing Sheets

ENHANCEMENT OF SHEET DEWATERING USING SOY FLOUR OR SOY PROTEIN

BACKGROUND OF THE INVENTION

1. Field of the Invention

This disclosure relates to compositions and methods for improving dewatering efficiency during a papermaking process or a pulp drying process. More particularly, the disclosure relates to the use of soy based dewatering agent solutions in a papermaking process or a pulp drying process to improve dewatering efficiency.

2. Description of the Related Art

In a typical papermaking process, a slurry of papermaking raw materials is dewatered to form a paper sheet. A method of making paper generally includes a series of different processes. At first, the slurry of raw materials is subjected to gravity or inertial dewatering. This can be carried out in the early forming section of the papermaking machine. Next, vacuum dewatering techniques are utilized, followed by press dewatering. Finally, the sheet is subjected to heat to evaporate any remaining water. This step takes place in the dryer section of the machine.

The cost of dewatering increases for each subsequent dewatering process. That is, gravity dewatering is less costly than press dewatering. Thus, it is advantageous to remove as much water as possible in the earlier dewatering processes. Essentially, the rate of paper production is dictated by the rate at which water can be removed. The production rate for the vast majority of paper machines is limited by the drying capacity of the machine's dryer section. Therefore, to speed up and reduce the cost of the papermaking process, it is highly advantageous to remove as much water as possible from the paper sheet before the sheet enters the dryer section. Therefore, any chemical treatment that can increase the rate of water removal from the sheet has value for the papermaker.

Many chemicals, such as retention aids, are known in the art and are used, for example, to retain the fine particles found in the raw materials used to make the paper. Such retention aids can also enhance the rate of gravity, inertial, and vacuum dewatering. These chemicals can be added to the papermaking furnish and can include flocculants, surfactants, coagulants, microparticles, retention aids, and the like.

BRIEF SUMMARY OF THE INVENTION

Methods for improving dewatering efficiency during a papermaking process are disclosed herein. In one aspect, the method for improving dewatering efficiency during a papermaking process comprises the step of adding a dewatering agent solution comprising an effective amount of a soy based component to a paper machine.

Methods for dewatering aqueous pulp slurries are also disclosed herein. In one aspect, the method for dewatering an aqueous pulp slurry comprises the steps of adding to an aqueous pulp slurry a dewatering agent solution comprising an effective amount of a soy based component and dewatering the pulp slurry.

Methods for improving dewatering efficiency during a pulp drying process are also disclosed. In one aspect, the method comprises the step of adding a dewatering agent solution comprising an effective amount of a soy based component to a pulp drying machine.

Dewatering agent solutions are also disclosed herein. In one aspect, a dewatering agent solution for improving dewatering efficiency during a papermaking process or a pulp drying process comprises an effective amount of a soy based component and an effective amount of a surfactant.

The foregoing has outlined rather broadly the features and technical advantages of the present disclosure in order for the detailed description that follows to be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE SEVERAL VIEWS OF THE DRAWINGS

A detailed description of the invention is hereafter described with specific reference being made to the drawings in which.

DETAILED DESCRIPTION

Figure 1:
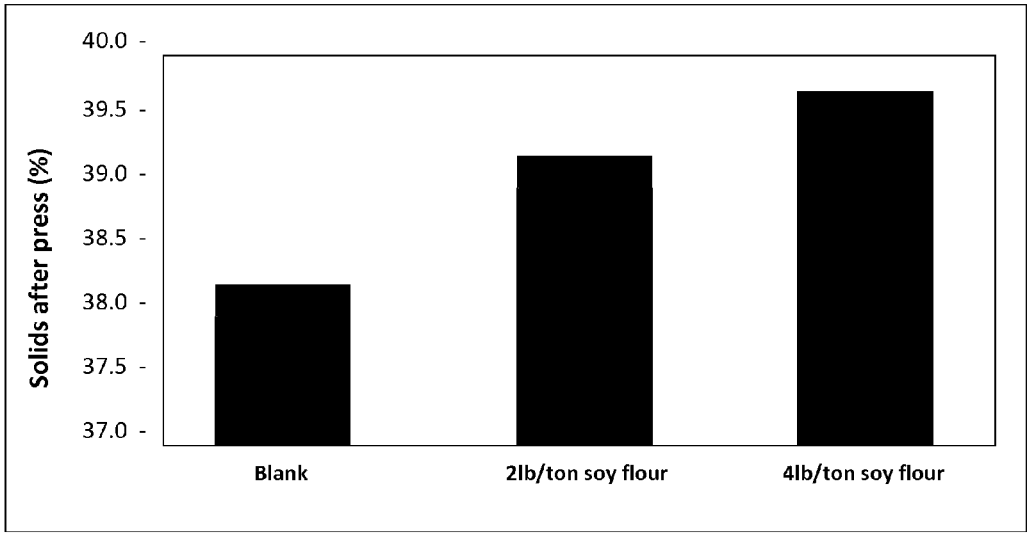
FIG. 1 depicts experimental data from a dewatering trial incorporating an aspect of the presently disclosed dewatering agent.

Compositions and methods for improving dewatering efficiency during a papermaking process or a pulp drying process are disclosed herein. A papermaking process is generally defined as a method of making paper products from pulp. The process can include the steps of forming an aqueous cellulosic papermaking furnish, draining the furnish to form a sheet, and drying the sheet. Additives, such as dewatering agents, can be added to the papermaking furnish to manipulate the draining or dewatering process. After addition of the additives, the pulp can be dewatered, usually on a fourdrinier or cylinder machine.

In a fourdrinier machine, the pulp furnish (also known as a "stock slurry") is deposited from a headbox onto a continuous, moving open mesh fabric. The water in the slurry drains through the fabric, resulting in the formation of a pulp mat. After the initial drainage through the fabric or wire, the mat is further dewatered as it is carried on the wire by the application of a progressively increasing vacuum. The vacuum is applied to the underside of the mat by a series of elements known as vacuum boxes. Vacuum may also be applied at the couch roll, prior to the removal of the mat from the forming fabric. Nominal mat consistency at this point is about 16% to about 20%. The pulp mat then enters the press section of the machine, which typically includes from about two to four press nips, where further water is removed by mechanical expression. The nominal mat consistency after pressing is from about 40% to about 50%. After the press section, further water is removed from the sheet by evaporative means, typically by hot air impingement in the dryer section. The final consistency of the sheet is generally in a range from about 80% to about 86% (oven-dry basis) or from about 90% to about 95% (air-dry basis).

In a cylinder machine, a vat contains the furnish and a rotating, fabric-covered cylinder is used for forming the mat. The furnish/slurry in the vat is picked up onto the cylinder and drainage of water occurs through the fabric/screen to form the mat. The mat is further vacuum dewatered on the cylinder, whereupon it is transferred to a press section and dryer section as described for the fourdrinier machine.

Dewatering can be maximized by working to achieve optimal performance of the mechanical water removal sections of the papermaking process, e.g. the vacuum, press, and dryer. In order to maximize dewatering, the stock temperature is kept as high as possible, typically from about 150° F. to about 160° F., to enhance water removal by lowering the water viscosity. Also, steam boxes can be used to increase the temperature of the mat prior to the press section.

One of ordinary skill in the art will understand that a pulp drying machine is similar to the above-described papermaking machine except that a pulp drying machine would not include a size press.

The present inventors have unexpectedly discovered that dewatering can also be maximized by adding certain dewatering agents to the papermaking machine or the pulp drying machine. It is to be understood that throughout the present disclosure, reference to a "dewatering agent" or "dewatering agent solution" can mean a single dewatering agent or dewatering agent solution, or it can mean any combination of two, three, four, or more of the presently disclosed dewatering agents or dewatering agent solutions. Any of the presently disclosed dewatering agents/dewatering agent solutions can be added to a location in a papermaking machine or pulp drying machine, such as the furnish, think stock, thick stock, etc., in a slurry or solution. If more than one dewatering agent is used in connection with a disclosed method, the dewatering agents or dewatering agent solutions can be added to the furnish in any order or the dewatering agents can be added simultaneously in a single solution or slurry, unless specified otherwise below. In one aspect, the dewatering agent solution is added to the furnish before the pulp is vacuum dewatered during the mat consolidation process. For example, the dewatering agent solution may be added prior to the headbox on a fourdrinier pulp dryer.

The presently disclosed dewatering agent solution can be added in traditional wet end locations used for conventional wet end additives. These locations can include, for example, the furnish, the thin stock, and/or the thick stock. The actual wet end location is not considered to be critical. The dewatering agent solution can also be added prior to the press section after the formation of the sheet. For example, the dewatering agent solution can be sprayed on the wet web prior to entering the press section. If the dewatering agent solution is added at this location, one can potentially reduce the required dosage and/or the effects of interferences that can occur in the wet end.

In certain aspects, the presently disclosed dewatering agent solution comprises soy. Hereinafter, this type of dewatering agent solution can be referred to as a "dewatering agent solution comprising a soy based component" or "a soy based dewatering agent solution," and is intended to include all formulations listed in this paragraph. For example, in one aspect, the presently disclosed dewatering agent solution comprises soy flour. In accordance with the present disclosure, it is to be understood that soy flour comprises about 50% starch and about 50% soy protein. In another aspect, the presently disclosed dewatering agent solution comprises soy protein. In an additional aspect, the dewatering agent solution comprises a combination of soy flour and soy protein. In other aspects, the dewatering agent solution consists of soy protein, meaning it does not include any further additives besides the soy protein. In still further aspects, the dewatering agent solution consists of soy flour, meaning it does not include any further additives besides the soy flour. In other aspects, the dewatering agent solution consists of a combination of soy protein and soy flour, meaning it does not include any further additives besides the combination of soy protein and soy flour.

A solution of soy flour can be prepared by one of ordinary skill in the art and as an illustrative example, about 10 grams of soy flour can be dispersed into about 90 grams of water. Next, approximately 15 mM of $Na_2S_2O_5$ can be added and the pH of the solution can be adjusted to between about 8 and about 9 by adding a base, such as, but not limited to, 0.1 N NaOH. Without wishing to be bound by any theory, it is hypothesized that the sodium metabisulfite ($Na_2S_2O_5$) assists with the dissolution of the soy flour to release soy proteins. The resulting solution may be stirred for about 1 hour before its addition to a papermaking furnish. Again, the foregoing is simply an illustrative example of a method of making a dewatering agent comprising a soy flour solution and the particular amounts set forth can be adjusted based upon the amount of pulp in the furnish.

A solution of soy protein can be prepared by one of ordinary skill in the art and in certain aspects, it can be prepared in a similar manner to the solution of soy flour. However, when preparing the solution of soy protein, one would not need to add sodium metabisulfite. Soy protein can be easily dissolved into water with the pH adjusted to about 8.

The effective amounts of dewatering agent in the dewatering agent solution are empirically determined based upon the characteristics of the pulp being dewatered, the papermaking machine equipment, the pulp drying machine equipment, and the raw materials contained in the slurry. With respect to the soy flour or soy protein component of the dewatering agent solution, the dose of the soy component is from about 0.05 lb/ton to about 20 lb/ton, based on pounds of soy per ton of dry pulp. In further aspects, the dose of the soy component is from about 1 lb/ton to about 15 lb/ton, or from about 1 lb/ton to about 10 lb/ton, based on pounds of soy per ton of dry pulp. In some aspects, the dose of soy component is from about 2 lb/ton to about 6 lb/ton and, in other aspects, the dose of soy component is from about 2 lb/ton to about 4 lb/ton, based on pounds of soy per ton of dry pulp.

Although the dewatering agent solution in accordance with certain aspects of the present disclosure is a soy based dewatering agent solution, in other aspects, a dewatering agent solution can comprise a flocculant. Any type of flocculant can be used in accordance with the present disclosure and in certain aspects, the flocculant is a cationic polymer. Therefore, in certain aspects, a soy based dewatering agent solution can be added to the furnish and a separate dewatering agent solution comprising a flocculant, such as a cationic polymer, can be added to the furnish. In some aspects, the soy based dewatering agent solution can be added to the furnish first, followed by the subsequent addition of the dewatering agent solution comprising the cationic polymer and in other aspects, the soy based dewatering agent solution can be added to the furnish after the addition of the dewatering agent solution comprising the cationic polymer.

Cationic polymers contemplated by the present disclosure can include monomers such as, but not limited to, acrylamide, allyl amine, vinyl amine, dialkylaminoalkyl acrylates, dialkylaminoalkyl acrylate quaternary salts, dialkylaminoalkyl acrylate acid salts, dialkylaminoalkyl methacrylates, dialkylaminoalkyl methacrylate quaternary salts, and dialkylaminoalkyl methacrylate acid salts. Alkyl groups generally include from about 1 to about 10 carbon atoms. In certain aspects, the alkyl groups include from about 1 to about 7 carbon atoms and, in additional aspects, the alkyl groups include from about 1 to about 4 carbon atoms.

Specific examples of cationic monomers that can be used in connection with the presently disclosed cationic polymers include, but are not limited to, one or more members selected from the group consisting of dimethylaminoethyl acrylate methyl chloride quaternary salt (DMAEA.MCQ), dimethylaminoethyl acrylate methyl sulfate quaternary salt, dimethyaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, dialkylaminoalkylacrylamides or methacrylamides and their quaternary or acid salts such as acrylamidopropyltrimethylammonium chloride, dimethylaminopropyl acrylamide methyl sulfate quaternary salt, dimethylaminopropyl acrylamide sulfuric acid salt, dimethylaminopropyl acrylamide hydrochloric acid salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldiethylammonium chloride and diallyldimethyl ammonium chloride (DADMAC).

In one particular aspect, a dewatering agent solution comprising soy flour is added to the furnish followed by the addition of a dewatering agent solution comprising dimethylaminoethyl acrylate methyl chloride quaternary salt/acrylamide (DMAEA.MCQ/AcAm). The active content of the cationic polymer in this aspect can be about 35%.

In certain aspects, the dose of cationic polymer is from about 0 lb/ton to about 5 lb/ton or from about 0.1 lb/ton to about 2 lb/ton, based on pounds of active cationic polymer per ton of dry pulp. In other aspects, the dose of the cationic polymer is from about 0.5 lb/ton to about 3 lb/ton and, in other aspects, the dose of the cationic polymer is from about 2 lb/ton to about 4 lb/ton, based on pounds of active cationic polymer per ton of dry pulp.

The cationic polymer dewatering agent solution could be in the form of an emulsion, such as a water in oil emulsion with, for example, about 35% polymer actives. The product would need to be made down or "inverted" before use and as one illustrative example, one could invert the polymer in the lab by mixing about 1 g of the cationic polymer into about 99 g of water under about 800 rpm stirring for about 30 minutes. This 1% product can then be diluted to a desired concentration (typically between about 0.01% and about 1%) before addition to the furnish. In the field, the product can be inverted using a make-down unit (mixing device) into about a 0.5% to about 1% solution, then post diluted to the desired solution concentration before feeding the solution into the furnish using a feeding pump.

In accordance with certain aspects of the present disclosure, a dewatering agent solution can also comprise one or more surfactants. Surfactants are compounds that lower the water surface tension, meaning the interfacial tension between water and one other liquid, or that between water and a solid. Surfactants are usually organic compounds that are amphiphilic, meaning they contain both hydrophobic groups (their tails) and hydrophilic groups (their heads). Therefore, a surfactant contains both a water insoluble component and a water soluble component. Surfactants can carry a cationic charge, an anionic charge, or no charge at all. In one aspect of the present disclosure, the surfactant can be a nonionic surfactant, such as a triblock copolymer of PEO-PPO-PEO, where PEO (polyethylene oxide) is hydrophilic and PPO (polypropylene oxide) is more hydrophobic. Thus, in one aspect of the present disclosure, a dewatering agent solution can comprise a triblock copolymer of PEO-PPO-PEO. Solutions of surfactants can be made by known processes in the art such as adding a known amount of surfactant to water and mixing to form the solution.

In certain aspects, the dose of the surfactant is from about 0 lb/ton to about 5 lb/ton or from about 0.5 lb/ton to about 2 lb/ton, based on pounds of surfactant per ton of dry pulp. In other aspects, the dose of the surfactant is from about 1 lb/ton to about 3 lb/ton or from about 2 lb/ton to about 4 lb/ton, based on pounds of surfactant per ton of dry pulp.

In particular aspects of the present disclosure, the dewatering agent solution comprises a mixture of soy flour and/or soy protein with one or more surfactants. In any aspect, the presently disclosed methods can simply comprise a dewatering agent solution comprising a soy based component, such as soy flour or soy protein. However, as noted above, additional dewatering agent solutions can be used. As illustrative examples, any method disclosed herein can include a first, soy based dewatering agent solution, such as a dewatering agent solution comprising soy flour and/or soy protein, a second dewatering agent solution comprising one or more cationic polymers, and a third dewatering agent solution comprising one or more surfactants. The order of addition of each dewatering agent solution into the furnish is not critical and as noted above, in certain aspects, the first dewatering agent solution can be combined with the third dewatering agent solution before addition to the furnish.

In one particular aspect, a dewatering agent solution for improving dewatering efficiency during a papermaking process or a pulp drying process comprises an effective amount of a soy based component and an effective amount of a surfactant. The soy based component may be any soy based component disclosed herein. For example, the soy based component may comprise soy flour and/or soy protein. The surfactant can be any surfactant disclosed herein. For example, the surfactant may be a triblock copolymer comprising polyethylene oxide and polypropylene oxide. The effective amounts of each component can be any amount of such component disclosed herein. For example, the effective amount of the soy based component may be from about 0.05 lb/ton to about 20 lb/ton and the effective amount of the surfactant may be from about 0.1 lb/ton to about 5 lb/ton.

Other additives can be used in combination with the presently disclosed dewatering agent solutions. However, it is noted that no additional additives are required for the proper functioning of the presently disclosed dewatering agents. The other additives can include, for example, retention aids, strength additives, sizing agents, microparticles, alum, or any combination thereof.

The presently disclosed dewatering agent solutions and additives can be used in methods for dewatering an aqueous cellulosic pulp slurry (e.g. a furnish). In certain aspects, a method for dewatering an aqueous pulp slurry can comprise a step of (a) adding to an aqueous pulp slurry an effective amount of a dewatering agent solution comprising a soy based component and (b) dewatering the pulp slurry. The soy based component can be soy protein and/or soy flour. A papermaking machine or a pulp drying machine can comprise the pulp slurry.

The presently disclosed dewatering agent solutions and additives can also be used in methods for enhancing the dewatering of a paper sheet on a paper machine. In one aspect, such a method comprises the step of (a) adding a dewatering agent solution comprising a soy based component to the paper machine. The soy based component can be soy protein and/or soy flour. With respect to the specific location to add the dewatering agent solution to the paper machine, one could add the dewatering agent solution to, for example, the wet end locations used for conventional wet end additives, the furnish, and/or at or prior to the press section. Further, the dewatering agent solution could be sprayed onto the paper sheet prior to press section dewatering.

The presently disclosed dewatering agent solutions and additives can further be used in methods for enhancing dewatering of a pulp drying machine. In one aspect, such a method comprises the step of (a) adding a dewatering agent solution comprising a soy based component to the pulp drying machine. The soy based component can be soy protein and/or soy flour. With respect to the specific location to add the dewatering agent solution to the pulp drying machine, one could add the dewatering agent solution to, for example, the wet end locations used for conventional wet end additives, the furnish, and/or at the machine headbox.

The presently disclosed dewatering agent solutions and additives can additionally be used in methods for improving dewatering efficiency during a papermaking process. In one aspect, this method includes the step of (a) adding a dewatering agent solution comprising a soy based component to a paper machine. The soy based component can be soy protein and/or soy flour. With respect to the specific location to add the dewatering agent solution to the paper machine, one could add the dewatering agent solution to, for example, the wet end locations used for conventional wet end additives, the furnish, and/or at or prior to the press section. Further, the dewatering agent solution could be sprayed onto the paper sheet prior to press section.

The foregoing may be better understood by reference to the following examples, which are presented for purposes of illustration and are not intended to limit the scope of the disclosure.

EXAMPLES

Example 1

A Thick Stock of Old Corrugated Cardboard (OCC) Furnish was obtained from a paper mill. The furnish was diluted to 1% using water and 1,200 mL of the resulting furnish solution was added into two different jars (600 mL into each jar) under 1200 rpm mixing. A solution of soy flour was added into the first jar in an amount of about 2 lb/ton and a solution of soy flour was also added into the second jar in an amount of about 4 lb/ton. The resulting solutions were mixed for 30 seconds.

Next, the furnish solutions were drained through a 100 mesh wire under a 300 mbar vacuum for 90 seconds. The weight of the resulting wet pad (sheet) was then recorded. Subsequently, the wet pad was placed between two felts. The sandwiched pad was then put on top of a metal wire and pressed using a static press under 7 bar pressure for 2 minutes.

The weight of the pressed pad was recorded before sending the pad into a heating oven having a temperature of about 105° C. overnight. Subsequently, the dry weight of the pad was recorded. The press solid was calculated according to the weight of the press pad and the dry pad.

As can be seen in FIG. 1, the addition of soy flour significantly improved the solids of the press pad. The higher the solids of the press pad, the lower the moisture content.

Example 2

The Same Steps Used to Conduct Example 1 were Repeated for example 2 except that 15 seconds after the soy flour solution was added into the furnish, 1 lb/ton of "Flocculant 1" was added as a solution into the furnish. Flocculant 1 is a copolymer of dimethylaminoethyl acrylate methyl chloride quaternary salt/acrylamide (DMAEA.MCQ/AcAm). The active content of the copolymer is 35%.

Figure 2:
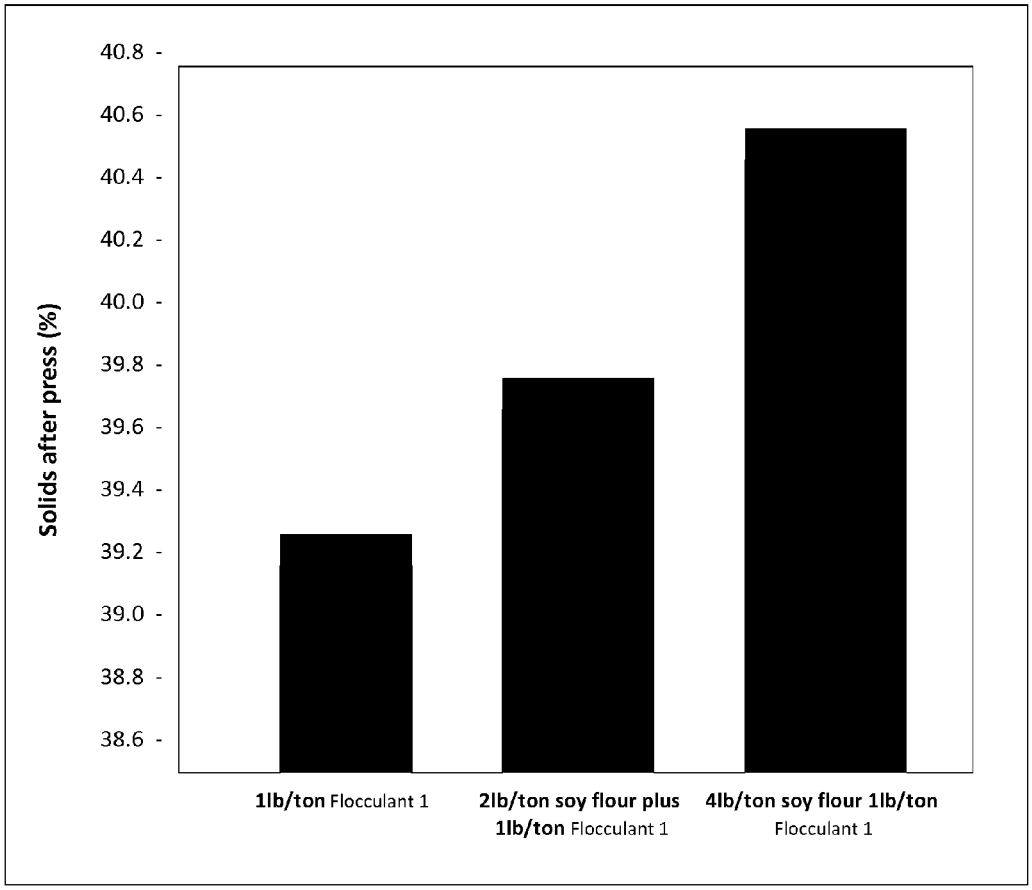
FIG. 2 depicts experimental data from a dewatering trial incorporating a different aspect of the presently disclosed dewatering agent.

The results from this experiment can be seen in FIG. 2. Again, it can be seen that the press dewatering effect from the incorporation of soy flour into the furnish is significant. It can also be seen that Flocculant 1 has a beneficial effect on the dewatering process.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a dewatering agent" is intended to include "at least one dewatering agent" or "one or more dewatering agents."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A method for improving dewatering efficiency during a papermaking process comprising:

adding a dewatering agent solution comprising an effective amount of a soy based component to a paper machine, wherein the effective amount of the soy based component is from about 0.05 lb/ton to about 20 lb/ton, based on pounds of soy per ton of dry pulp.

2. The method of claim 1, wherein the soy based component comprises soy flour.

3. The method of claim 1, wherein the soy based component comprises soy protein.

4. The method of claim 1, wherein the dewatering agent solution is added to a wet end location of the paper machine.

5. The method of claim 1, wherein the dewatering agent solution is sprayed onto a paper sheet prior to entering a press section.

6. The method of claim 1, further comprising a step of adding a dewatering agent solution comprising an effective amount of a cationic polymer to the paper machine.

7. The method of claim 6, wherein the cationic polymer comprises dimethylaminoethyl acrylate methyl chloride quaternary salt and acrylamide.

8. The method of claim 6, wherein the effective amount of the cationic polymer is from about 0.1 lb/ton to about 5 lb/ton, based on pounds of active cationic polymer per ton of dry pulp.

9. The method of claim 1, further comprising a step of adding a dewatering agent solution comprising an effective amount of a surfactant to the paper machine.

10. The method of claim 9, wherein the surfactant is a triblock copolymer comprising polyethylene oxide and polypropylene oxide.

11. The method of claim 9, wherein the effective amount of the surfactant is from about 0.1 lb/ton to about 5 lb/ton, based on pounds of surfactant per ton of dry pulp.

12. The method of claim 1, further comprising a step of adding one or more additives to the paper machine, wherein the one or more additives are selected from the group consisting of retention aids, strength additives, sizing agents, microparticles, alum, and any combination thereof.

13. A method for improving dewatering efficiency during a pulp drying process comprising:

adding a dewatering agent solution comprising an effective amount of a soy based component to a pulp drying machine, wherein the effective amount of the soy based component is from about 0.05 lb/ton to about 20 lb/ton, based on pounds of soy per ton of dry pulp.

14. The method of claim 13, further comprising the step of adding a dewatering agent solution comprising an effective amount of a cationic polymer to the pulp drying machine.

15. The method of claim 13, further comprising the step of adding a dewatering agent solution comprising an effective amount of a surfactant to the pulp drying machine.

* * * * *